US010784609B2

(12) United States Patent
Szymura et al.

(10) Patent No.: US 10,784,609 B2
(45) Date of Patent: Sep. 22, 2020

(54) CYLINDRICAL HIGH POWER CONTACT CONNECTOR SOCKET

(71) Applicant: Amphenol-Tuchel Electronics GmbH, Heilbronn (DE)

(72) Inventors: Dawid Szymura, Ilsfeld (DE); Alexander Schreck, Heilbronn (DE); Denis Gleiter, Pfleidelsheim (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 16/463,709

(22) PCT Filed: Nov. 28, 2017

(86) PCT No.: PCT/EP2017/080636
§ 371 (c)(1),
(2) Date: May 23, 2019

(87) PCT Pub. No.: WO2018/099904
PCT Pub. Date: Jun. 7, 2018

(65) Prior Publication Data

US 2019/0326695 A1 Oct. 24, 2019

(30) Foreign Application Priority Data

Nov. 30, 2016 (DE) ..... 10 2016 123 081

(51) Int. Cl.
*H01R 4/28* (2006.01)
*H01R 13/187* (2006.01)
(Continued)

(52) U.S. Cl.
CPC ..... *H01R 13/187* (2013.01); *H01R 4/48* (2013.01); *H01R 13/11* (2013.01)

(58) Field of Classification Search
CPC .... H01R 13/052; H01R 13/113; H01R 13/26; H01R 13/187; H01R 13/11; H01R 4/48
(Continued)

(56) References Cited

U.S. PATENT DOCUMENTS 4,662,706 A * 5/1987 Foley ..... H01R 13/187 439/843
5,431,576 A * 7/1995 Matthews ..... H01R 13/113 439/247
(Continued)

FOREIGN PATENT DOCUMENTS

CN 105390843 A 3/2016
DE 4242972 A1 6/1994
(Continued)

*Primary Examiner* — Jean F Duverne
(74) *Attorney, Agent, or Firm* — Blank Rome LLP

(57) ABSTRACT

The invention relates to a cylindrical connector socket having a contact cage which comprises a plurality of contact springs extending along a plug-in direction S for electrically conductive contacting with a connector which can be plugged into the cylindrical connector socket in the plug-in direction S. The contact cage has a first end margin and a second end margin, wherein a first set of contact springs is formed from the first end margin and a second set of contact springs is formed from the second end margin. The contact springs in the first and the second set each have a fixed end with which they are fastened to one of the margins and each have a free end, which projects in the direction of the other margin.

14 Claims, 1 Drawing Sheet

(51) Int. Cl.
*H01R 4/48* (2006.01)
*H01R 13/11* (2006.01)

(58) Field of Classification Search
USPC ..... 439/775
See application file for complete search history.

(56) References Cited

U.S. PATENT DOCUMENTS

| | | | | | |
|---|---|---|---|---|---|
| 5,575,690 | A * | 11/1996 | Eaton | H01R 13/187 | 439/176 |
| 5,676,571 | A * | 10/1997 | Matthews | H01R 13/187 | 439/839 |
| 6,299,492 | B1 * | 10/2001 | Pierini | H01R 13/26 | 439/884 |
| 8,821,170 | B1 | 9/2014 | Thein et al. | | |
| 10,218,105 | B2 * | 2/2019 | Stange | H01R 13/113 | |
| 10,224,659 | B2 * | 3/2019 | Pemwieser | H01R 13/052 | |

FOREIGN PATENT DOCUMENTS

| | | |
|---|---|---|
| DE | 20 2016 100095 U1 | 1/2016 |
| EP | 0 674 813 A1 | 10/1995 |
| WO | WO 94/15380 | 7/1994 |

* cited by examiner

CYLINDRICAL HIGH POWER CONTACT CONNECTOR SOCKET

RELATED APPLICATIONS

This application is a national stage application of International Application No. PCT/EP2017/080636, filed Nov. 28, 2017, which is related to and claims priority to German Patent Application No. 10 2016 123 081.2, filed Nov. 30, 2016, the entire disclosures of which are hereby incorporated by reference.

The invention relates to a cylindrical connector socket.

Various forms of embodiment of so-called "Radsok®" sockets are already known from the prior art. Many of them, however, exhibit a current-carrying capacity that is too small for many applications as a result of a transfer resistance that is too high. The majority of the available sockets, moreover, have a high installation space requirement in the axial direction, which can lead to problems in some applications.

The invention is therefore based on the object of overcoming the above-mentioned disadvantages and providing a solution that is compact and that can carry a high current load.

This object is achieved through the feature combination as claimed in claim 1.

According to the invention therefore a cylindrical connector socket having a contact cage is proposed, comprising a plurality of contact springs extending along an insertion direction for electrically conductive contact with a connector which can be plugged into the cylindrical connector socket in the insertion direction. The contact cage has a first end contact collar and a second end contact collar, wherein a first set of contact springs is formed from the first end contact collar and a second set of contact springs is formed from the second end contact collar. The contact springs of the first and the second set each comprise a fixed end with which they are fastened to one of the contact, collars, and each has a free end, which projects in the direction of the respective other contact collar. Through the implementation of the contact springs with a free end, the contact spring region, which is normally necessary in order to unite with the cage again, can be saved. As a result, shorter constructions of the cage, the sleeve, and thereby of the entire socket, are possible.

One advantageous form of embodiment provides that the contact springs respectively have a contact point with the connector when in the inserted state. There is a spacing between the contact points of the first set and the contact points of the second set along the insertion direction. As a result, the contact points on the connector do not all lie on one circumference, but are divided over at least two contact levels. The loading at the connector is thereby also divided.

An alternative form of embodiment, which however is also advantageous, is present if the contact cage has a circular cross-section corresponding to the connector, wherein the contact cage is formed as a tube at least partially enclosing the connector along its longitudinal axis when in the inserted state, with an outer surface lying at least partially against an inner sleeve wall of a sleeve and is at least partially radially and axially surrounded by the sleeve. Through the circular cross-section and the tubular form of the socket resulting therefrom, a round or cylindrical connector can be optimally enclosed and contacted. Depending on the material of the sleeve, this can serve to conduct the current away from the contact cage and to stabilize and fix it mechanically, or merely to stabilize and fix it mechanically.

It is advantageous for one form of embodiment if the sleeve, in the event that the connector is not in the inserted state, has a contact gap in the radial direction to the respective free end of the contact springs. The contact springs are thus only in contact with the sleeve through one side. They act here like springs which must be pressed down by a force resulting when the connector is inserted. A higher insertion resistance thus results. The connector is, however, centered by the spring force, and the contact springs clamp the connector between them.

One advantageous embodiment is characterized in that the respective free end of the contact springs touches the sleeve, at least when the connector is in the inserted state. Due to the contact spring lying on the sleeve at two points, a current can be transferred to the sleeve at both locations.

One advantageous development is present if, at least during an insertion process when inserting or removing the connector, the free ends of the contact springs travel a distance along the insertion direction, wherein they are in contact with the inner sleeve wall along a segment of the path. Through this sliding or scraping along the inner sleeve wall, any layer of oxide or dirt that may be present along the path is removed each time by the free ends. A lower transfer resistance is present when current is transferred from the contact springs to the sleeve as a result of this cleaning effect, which improves the current-carrying capacities.

In addition, a form of embodiment is also advantageous in which the free end of the contact spring is formed like a wedge, so that an acute angle points in the direction of the sleeve and scrapes along the path segment against the inner sleeve wall. The scraping effect along the inner sleeve wall is thereby increased, and the cleaning capacity improved.

It is furthermore advantageous for one form of embodiment if the contact springs each comprise, from their fixed ends along the insertion direction, a straight first segment lying against the sleeve which merges at a first inflection point into an arched second segment, which merges at a second inflection point into an arched third segment, which merges into the free end, wherein an apex of the arched third segment has a distance from an axis of rotation of the sleeve that is less than another distance to the axis of rotation of the sleeve of a point on the segments.

An advantageous development is further given if the contact springs of the first set and the contact springs of the second set are arranged in alternation, wherein the contact springs of the first set and of the second set extend along the insertion direction over a common region and wherein there is a gap in each case between the contact springs, and wherein there is a spring gap between the first and second set and the respective other contact collar. This interleaving or interlinking of the contact springs has the result that the current is guided alternately through the first and second contact collar and through the respective springs.

It is advantageous for an alternative form of embodiment if the contact springs of the first set and of the second set extend along the insertion direction over different, non-overlapping regions, and wherein in each case there is a gap between the contact springs. Two entirely separated sets of contact springs are created as a result which, due to a possibly shorter implementation of the spring elements, may take up the same installation space, but since the spring elements of each set of contact springs can be placed closer to one another create twice as many contact points as an arrangement of the contact springs in interlinked form.

Another advantageous form of embodiment is present if a dimension from the fixed end to the free end of the contact springs along the insertion direction amounts to between 70% and 90% of a spacing between the contact collars. The interlinking and the distance between the respective free ends and the respective opposite contact collars result from this. A further advantageous embodiment alternatively provides that a dimension from the fixed end to the free end of the contact springs along the insertion direction amounts to between 20% and 45% of a spacing between the contact collars. The two entirely separate sets of contact springs, which have no interlinking or overlapping, result from this.

It is also advantageous for one development if at least one connecting bridge connects the two contact collars together. The position of the set of contact springs and the contact collar with respect to one another is defined in this way, and the storm will be conducted between the cage and sleeve via a higher surface.

A form of embodiment is further advantageous in which the first contact collar is fixed to the sleeve, preferably in all directions. This prevents the contact collar from slipping.

A form of embodiment is also advantageous in which the second contact collar is fixed to the sleeve, preferably in the radial direction, so that a movement of the second contact collar is possible in the insertion direction. Through the pairing with the fixed upper contact collar, a fixed/floating bearing results for the connector.

One advantageous development provides that the first and second contact collars are annular in form, wherein the contact collars each from an interruption, wherein a first end at the interruption has a V-shape which corresponds to a second end of the interruption with a negative V-shape.

Other advantageous developments of the invention are identified in the subsidiary claims or are illustrated in more detail below together with the description of the preferred embodiment of the invention with reference to the figures. Here:

The figures are exemplary and schematic. The same reference signs in the figures indicate the same functional and/or structural features.

Figure 1:
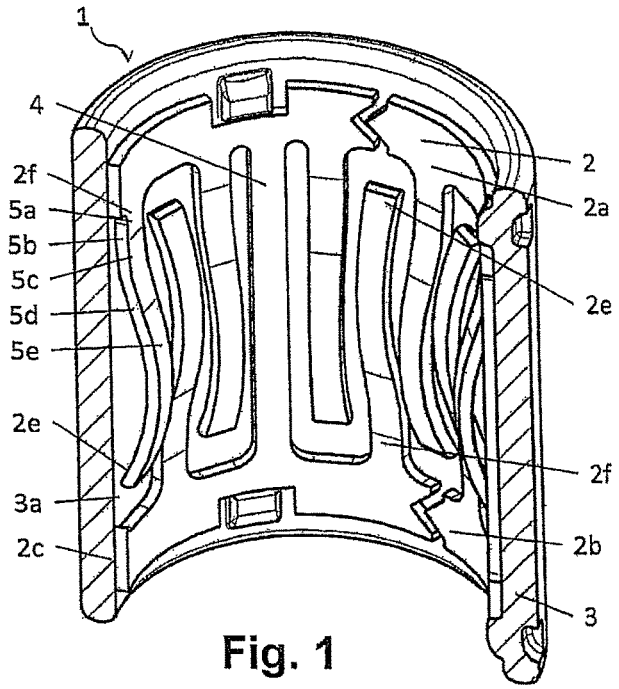
FIG. 1 shows a cylindrical high-power contact connector socket illustrated as a three-dimensional cross-section.
Figure 2:
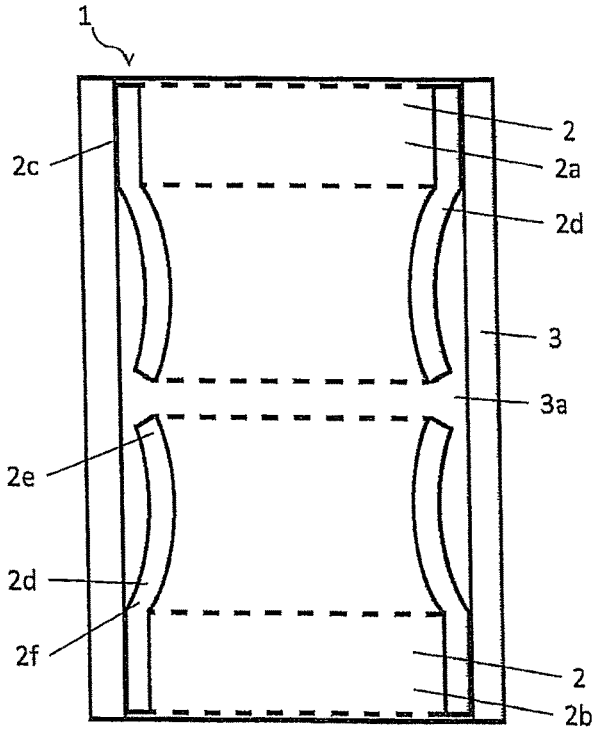
FIG. 2 shows an alternative form of embodiment of the cylindrical high-power contact connector socket illustrated as a two-dimensional cross-section.

FIG. 1 and FIG. 2 each show a possible form of embodiment of the cylindrical connector socket 1. The sleeve 3, with its inner sleeve wall 3*a*, as well as the contact cage 2 with the first contact collar 2*a* and the second contact collar 2*b*, and the outer surfaces 2*c* are to be seen here. A plurality of contact springs 2*d* are, including their free ends 2*e*, their fixed ends 2*f*, each of which is in connection with one contact collar.

FIG. 1 furthermore shows the connecting bridge 4 that joins the contact collars 2*a* and 2*b* of the contact cage 2 together. In FIG. 1 it is furthermore possible to see, at each of the contact springs, their first segment 5*a* which merges at a first inflection point 5*b* into the arched second segment 5*c* before the contact spring merges at a second inflection point 5*d* into an arched third segment 5*e* which culminates in the free end 2*e*.

FIG. 2 shows a simplified form of the contact springs implemented as a simple arch curving towards the inside.

The implementation of the invention is not restricted to the preferred exemplary embodiments given above. Rather is a number of variants conceivable which make use of the illustrated solution even in the case of fundamentally different types of embodiment. The form of the contact springs could, for example, take the form of a double arch, so that two contact points with the connector are formed for each contact spring.

LIST OF REFERENCE SIGNS

1 Cylindrical connector socket
2 Contact cage
2*a* First contact collar
2*b* Second contact collar
2*c* Outer surface
2*d* Contact spring
2*e* Free end
2*f* Fixed end
3 Sleeve
3*a* Inner sleeve wall
4 Connecting bridge
5*a* First segment
5*b* First inflection point
5*c* Second segment
5*d* Second inflection point
5*e* Third segment
S Insertion direction

The invention claimed is:

1. A cylindrical connector socket having a contact cage, comprising:

a plurality of contact springs extending along an insertion direction for electrically conductive contact with a connector which can be plugged into the cylindrical connector socket in the insertion direction, wherein the contact cage has a first end contact collar and a second end contact collar, a first set of the contact springs is formed from the first end contact collar and a second set of the contact springs is formed from the second end contact collar, wherein the contact springs of the first and the second set each comprise a fixed end with which they are fastened to one of the first and second end contact collars, and each has a free end, which projects in a direction of the respective other of the first and second end contact collars, and wherein the contact springs of the first set and of the second set extend along the insertion direction over different, non-overlapping regions, such that there is a gap between the free ends of the contact springs of the first set and the free ends of the contact springs of the second set.

2. The cylindrical connector socket as claimed in claim 1, wherein the contact springs respectively have a contact point with the connector when in an inserted state, wherein there is a spacing between the contact points of the first set of the contact springs and the contact points of the second set of the contact springs along the insertion direction.

3. The cylindrical connector socket as claimed in claim 1, wherein the contact cage has a circular cross-section corresponding to the connector, wherein the contact cage is formed as a tube at least partially enclosing the connector along its longitudinal axis when in an inserted state, with an outer surface lying at least partially against an inner sleeve wall of a sleeve and is at least partially radially and axially surrounded by the sleeve.

4. The cylindrical connector socket as claimed in claim 3, wherein the sleeve, when the connector is not in the inserted state, has a contact gap in a radial direction to the respective free end of the contact springs.

5. The cylindrical connector socket as claimed in claim 3, wherein the respective free end of the contact springs touches the sleeve, at least when the connector is in the inserted state.

6. The cylindrical connector socket as claimed in claim 3, wherein at least during an insertion process when inserting or removing the connector, the free ends of the contact springs travel a distance along the insertion direction, wherein they are in contact with an inner sleeve wall of the sleeve along a segment of the travel path.

7. The cylindrical connector socket as claimed in claim 6, wherein the free end of each of the contact spring is formed like a wedge, so that an acute angle points in the direction of the sleeve and scrapes along the path segment against the inner sleeve wall.

8. The cylindrical connector socket as claimed in claim 3, wherein the contact springs each comprise, from their fixed ends along the insertion direction, a straight first segment lying against the sleeve which merges at a first inflection point into an arched second segment, which merges at a second inflection point into an arched third segment, which merges into the free end, wherein an apex of the arched third segment has a distance from an axis of rotation of the sleeve that is less than another distance to the axis of rotation of the sleeve of a point on the segments.

9. The cylindrical connector socket as claimed in claim 1, wherein the contact springs of the first set and the contact springs of the second set are arranged in alternation, wherein the contact springs of the first set and of the second set extend along the insertion direction over a common region and wherein there is a gap in each case between the contact springs, and wherein there is a spring gap between the first and second set of the contact springs and the respective other contact collar.

10. The cylindrical connector socket as claimed in claim 9, wherein a dimension from the fixed end to the free end of the each of the contact springs along the insertion direction amounts to between about 70% and 90% of a spacing between the first and second end contact collars.

11. The cylindrical connector socket as claimed in claim 1, wherein a dimension from the fixed end to the free end of the each of the contact springs along the insertion direction amounts to between about 20% and 45% of a spacing between the first and second end contact collars.

12. The cylindrical connector socket as claimed in claim 1, wherein at least one connecting bridge connects the first and second end contact collars together.

13. The cylindrical connector socket as claimed in claim 1, wherein the first end contact collar is fixed to the sleeve in all directions.

14. The cylindrical connector socket as claimed in claim 1, wherein the second end contact collar is fixed to the sleeve in the radial direction, so that a movement of the second end contact collar is possible in the insertion direction.

* * * * *